US008007064B2

(12) United States Patent
Tsuchiya

(10) Patent No.: US 8,007,064 B2
(45) Date of Patent: Aug. 30, 2011

(54) IMAGE FORMING APPARATUS, IMAGE FORMING METHOD, AND RECORDING MEDIUM STORING PROGRAM THAT CAUSES THE APPARATUS TO EXECUTE THE METHOD

(75) Inventor: Tomokazu Tsuchiya, Atsugi (JP)

(73) Assignee: Ricoh Company Limited, Tokyo (JP)

( * ) Notice: Subject to any disclaimer, the term of this patent is extended or adjusted under 35 U.S.C. 154(b) by 360 days.

(21) Appl. No.: 12/401,933

(22) Filed: Mar. 11, 2009

(65) Prior Publication Data

US 2009/0231367 A1 Sep. 17, 2009

(30) Foreign Application Priority Data

Mar. 12, 2008 (JP) ..... 2008-062104

(51) Int. Cl.
*B41J 2/195* (2006.01)

(52) U.S. Cl. ..... 347/7; 347/14; 347/23

(58) Field of Classification Search ..... 347/5, 7, 347/9, 14, 19, 23
See application file for complete search history.

(56) References Cited

U.S. PATENT DOCUMENTS

| | | | | |
|---|---|---|---|---|
| 6,364,442 | B1 * | 4/2002 | Kawase et al. | 347/5 |
| 6,916,076 | B2 * | 7/2005 | Yoshiyama et al. | 347/7 |
| 2008/0225070 | A1 | 9/2008 | Morishita et al. | |

FOREIGN PATENT DOCUMENTS

| | | |
|---|---|---|
| EP | 1 025 997 B1 | 8/2000 |
| EP | 1 213 148 B1 | 6/2002 |
| JP | 2004-122424 | 4/2004 |
| JP | 2006-256005 | 9/2006 |

* cited by examiner

*Primary Examiner* — Lam S Nguyen
(74) *Attorney, Agent, or Firm* — Oblon, Spivak, McClelland, Maier & Neustadt, L.L.P.

(57) ABSTRACT

An image forming apparatus includes ink cartridges, image forming units, an ink-remaining-amount manager, a maintenance determiner, an information writer, an ink-amount estimator, and a maintenance-executability determiner. If an ink near-empty or empty state occurs in one of the ink cartridges due to image formation, the ink-amount estimator estimates an amount of ink required to execute the maintenance on the other ink cartridges based on the at least one of the need for and the type of maintenance determined by the maintenance determiner. If the maintenance-executability determiner determines that the maintenance is unexecutable on at least one of the other ink cartridges based on the required ink amount and a remaining ink amount, the maintenance-executability determiner determines that the unexecutable ink cartridge is at an ink near-empty or empty state and stops writing or updating information indicative of a spent state on the memory of the unexecutable ink cartridge.

15 Claims, 9 Drawing Sheets

IMAGE FORMING APPARATUS, IMAGE FORMING METHOD, AND RECORDING MEDIUM STORING PROGRAM THAT CAUSES THE APPARATUS TO EXECUTE THE METHOD

CROSS-REFERENCE TO RELATED APPLICATIONS

The present patent application claims priority pursuant to 35 U.S.C. §119 from Japanese Patent Application No. 2008-062104, filed on Mar. 12, 2008 in the Japan Patent Office, the entire contents of which are hereby incorporated herein by reference.

BACKGROUND OF THE INVENTION

1. Field of the Invention

Example embodiments of the present invention relate to an image forming apparatus such as an inkjet recording apparatus, an image forming method, and a recording medium storing a program that causes the apparatus to execute the method.

2. Description of the Background

Image forming apparatuses are used as printers, facsimile machines, copiers, and multi-functional devices combining several of the foregoing capabilities. As one of such image forming apparatuses, an inkjet recording apparatus is known that employs a liquid-ejection recording method in which the apparatus performs image formation (hereinafter, recording, printing, and imaging are used as synonyms thereof) by ejecting droplets of ink from a recording head onto a recording medium or sheet.

Such an inkjet image forming apparatus also performs maintenance on the recording head to maintain the recording head in good condition. However, such maintenance consumes a relatively large amount of ink, in fact, more ink than is required for printing.

Consequently, it can happen that maintenance may not be executed even though a sufficient amount of ink required for printing remains in a given ink cartridge. In such a case, the ink cartridge is deemed to be empty or nearly empty of ink, processed as a near-empty or empty error, and rendered unusable. Further, an alert is displayed to prompt a user to replace the ink cartridge.

When, for example, an ink near-empty or empty error occurs in a first one of a plurality of ink cartridges, one conventional inkjet image forming apparatus compares the amount of ink required to execute a cartridge replacement sequence to the amount of ink remaining in each of the other ink cartridges. If the amount of ink remaining in any second one of the other ink cartridges is less than the required ink amount, the apparatus processes the second ink cartridge as the ink near-empty or empty error.

However, the conventional processing of such an ink near-empty or empty error may have the following disadvantages.

For example, the amount of ink consumed in cartridge replacement is in fact selected from among a plurality of different cartridge replacement sequences depending on the condition of the recording head or the apparatus. Therefore, since what is considered to be the necessary minimum amount of ink remaining in each of the ink cartridges varies depending on the type of selected cartridge replacement sequence, it may be impossible to determine a single threshold applicable to all the ink cartridges when simultaneously prompting the replacement of a plurality of ink cartridges.

Also, when an ink empty error occurs in one of the plurality of ink cartridges, an ink cartridge in which less ink than a threshold amount remains is processed as an ink near-empty or empty error, and processing for rendering the cartridge unusable is executed. Consequently, such an ink cartridge in which a sufficient amount of ink for printing still remains (but not enough ink for maintenance) may nevertheless be rendered unusable anyway, inadvertently resulting in waste of ink.

SUMMARY OF THE INVENTION

The present disclosure provides an image forming apparatus and an image forming method capable of effectively using ink in an ink cartridge for printing while preventing ink from being wasted in cartridge replacement, and a recording medium storing instructions that control the image forming apparatus to execute the image forming method.

In one illustrative embodiment, an image forming apparatus includes a plurality of ink cartridges, a plurality of image forming units, an ink-remaining-amount manager, a maintenance determiner, an information writer, an ink-amount estimator, and a maintenance executability determiner. The plurality of ink cartridges each contains ink and includes a memory on which information is writable or updatable. The plurality of image forming units forms images using the ink contained in the corresponding ink cartridges. The ink-remaining-amount manager manages an amount of ink remaining in each of the plurality of image forming units. The maintenance determiner determines at least one of a need for and a type of maintenance to be executed on each of the image forming units. The information writer writes or updates, when an ink near-empty or empty state occurs in a first one of the ink cartridges, information indicative of a spent state on the memory of the first ink cartridge. The ink-amount estimator estimates an amount of ink required to execute the maintenance on each of the ink cartridges. The maintenance executability determiner determines executability of the maintenance on each of the ink cartridges by comparing the remaining ink amount obtained from the ink-remaining-amount manager and the required ink amount obtained from the ink-amount estimator. If the ink near-empty or empty state of the first ink cartridge is caused by image formation, the ink-amount estimator estimates an amount of ink required to execute the maintenance on each of the other ink cartridges based on the at least one of the need for and the type of maintenance determined by the maintenance determiner to be executed on each of the plurality of image forming units. If the maintenance executability determiner determines that the maintenance is not executable on at least one of the other ink cartridges based on the required ink amount and the remaining ink amount, the maintenance executability determiner determines that the at least one ink cartridge is at an ink near-empty or empty state and stops writing or updating the information indicative of the spent state on the memory of the at least one ink cartridge.

In another illustrative embodiment, an image forming method is used in an image forming apparatus including a plurality of ink cartridges to contain ink, each ink cartridge including a memory on which information is writable or updatable, and a plurality of image forming units to form images using the ink contained in the corresponding ink cartridges. The method includes managing an amount of ink remaining in each of the plurality of image forming units, determining at least one of a need for and a type of maintenance to be executed on each of the image forming units, writing or updating, when an ink near-empty or empty state occurs in a first one of the ink cartridges, information indicative of a spent state on the memory of the first ink cartridge, estimating an amount of ink required to execute the maintenance on each of the ink cartridges, and determining executability of the maintenance on each of the ink cartridges by comparing the remaining ink amount and the required ink amount. If the ink near-empty or empty state of the first ink cartridge is caused by image formation, the estimating estimates an amount of ink required to execute the maintenance on each of the other ink cartridges based on the at least one of the need for and the type of maintenance determined in the determining the at least one of the need for and the type of maintenance to be executed on each of the plurality of image forming units. If the determining executability of the maintenance determines that the maintenance is not executable on at least one of the other ink cartridges based on the required ink amount and the remaining ink amount, the method includes determining that the at least one ink cartridge is at an ink near-empty or empty state and stopping writing or updating the information indicative of the spent state on the memory of the at least one ink cartridge.

In still another illustrative embodiment, a recording medium stores program codes causing an image forming apparatus to execute an image forming method, the image forming apparatus including a plurality of ink cartridges to contain ink, each ink cartridge including a memory on which information is writable or updatable, and a plurality of image forming units to form images using the ink contained in the corresponding ink cartridges. The method includes managing an amount of ink remaining in each of the plurality of image forming units, determining at least one of a need for and a type of maintenance to be executed on each of the image forming units, writing or updating, when an ink near-empty or empty state occurs in a first one of the ink cartridges, information indicative of a spent state on the memory of the first ink cartridge, estimating an amount of ink required to execute the maintenance on each of the ink cartridges, and determining executability of the maintenance on each of the ink cartridges by comparing the remaining ink amount and the required ink amount. If the ink near-empty or empty state of the first ink cartridge is caused by image formation, the estimating estimates an amount of ink required to execute the maintenance on each of the other ink cartridges based on the at least one of the need for and the type of maintenance determined in the determining the at least one of the need for and the type of maintenance to be executed on each of the plurality of image forming units. If the determining executability of the maintenance determines that the maintenance is not executable on at least one of the other ink cartridges based on the required ink amount and the remaining ink amount, the method includes determining that the at least one ink cartridge is at an ink near-empty or empty state and stopping writing or updating the information indicative of the spent state on the memory of the at least one ink cartridge.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
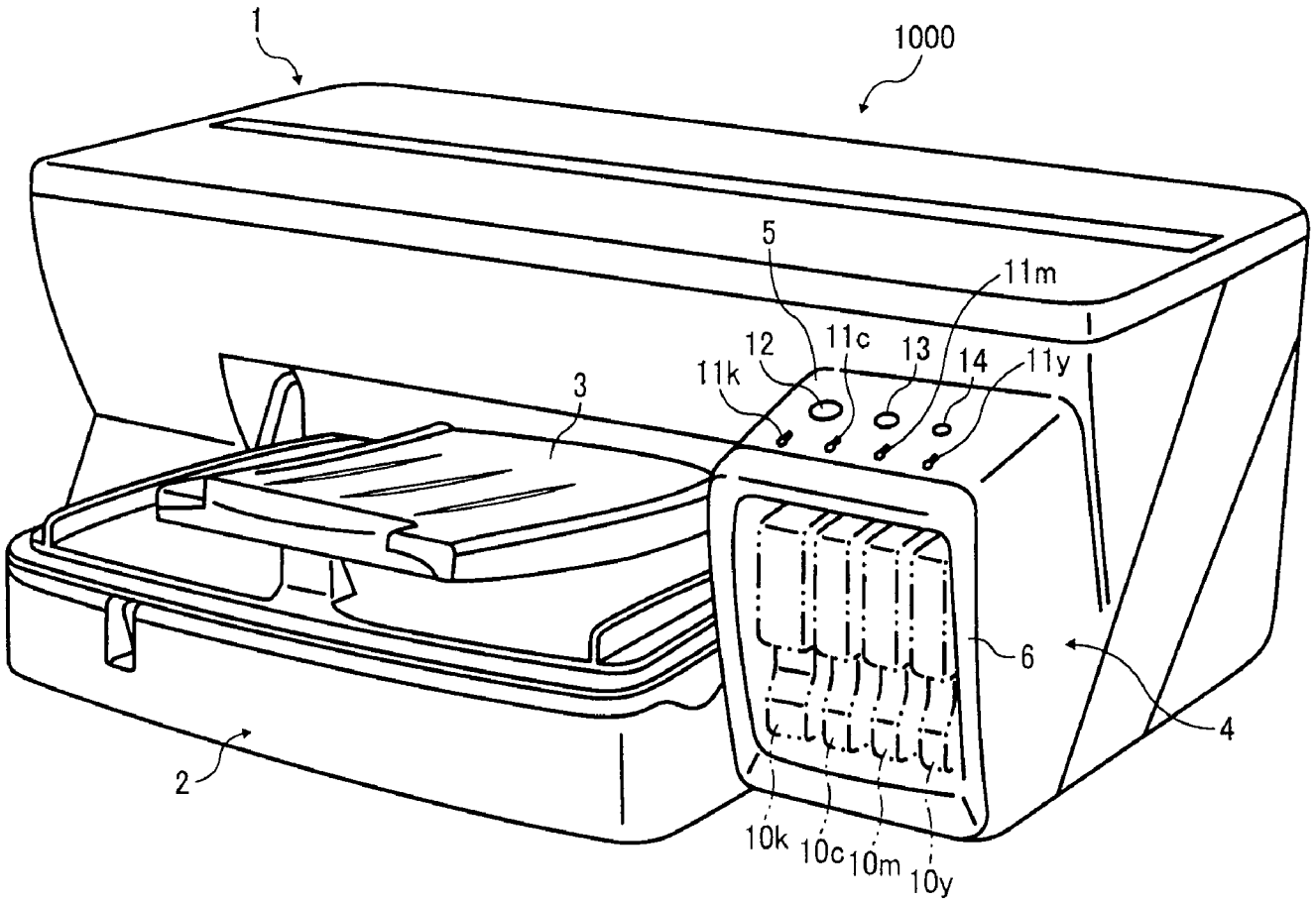
FIG. 1 is a schematic perspective view of an inkjet recording apparatus illustrated as an image forming apparatus according to an illustrative embodiment of the present disclosure, which is seen from the front side of the inkjet recording apparatus.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

A description is given of an image forming apparatus, an image forming method, and a recording medium storing a program that causes the apparatus to execute the method according to an illustrative embodiment of the present disclosure.

FIG. 1 is a perspective view illustrating an inkjet recording apparatus 1000 as one example of the image forming apparatus according to the present disclosure seen from the front side of the inkjet recording apparatus 1000.

In FIG. 1, the inkjet recording apparatus 1000 includes an apparatus body 1, a sheet feed tray 2 to load sheets in the apparatus body 1, and a discharge tray 3 detachably mountable in the apparatus body 1 to stack sheets on which images are recorded (formed). The inkjet recording apparatus 1000 also includes a cartridge mount portion 4 to mount ink cartridges. The cartridge mount portion 4 is disposed at one end portion of the front side of the apparatus body 1 alongside the sheet feed tray 2 and the discharge tray 3. The cartridge mount portion 4 is also positioned lower than the top face of the apparatus body 1 so as to project from the front side of the apparatus body 1. At the top face of the cartridge mount portion 4 is provided an operation-and-indication portion 5 including operation buttons and indicators.

In the cartridge mount portion 4 is detachably mountable a plurality of ink cartridges serving as recording-liquid containers that contain a plurality of different color materials such as inks or other recording liquids. As illustrated in FIG. 1, for example, different color inks of black (K), cyan (C), magenta (M), and yellow (Y) may be contained in a plurality of ink cartridges 10*k*, 10*c*, 10*m*, and 10*y*, respectively (hereinafter collectively referred to as "ink cartridges 10" unless the colors are distinguished). The ink cartridges 10 are inserted from the front side toward the rear side of the apparatus body 1 to mount to the cartridge mount portion 4. A front cover (cartridge cover) 6 is provided in an openable and closable manner at the front side of the cartridge mount portion 4, and is opened when the ink cartridges 10 are mounted or detached from the cartridge mount portion 4. The ink cartridges 10*k*, 10*c*, 10*m*, and 10*y* are vertically oriented and horizontally arranged side by side to mount in the cartridge mount portion 4.

In the operation-and-indication portion 5, remaining-amount indicators 11*k*, 11*c*, 11*m*, and 11*y* (hereinafter, collectively referred to as "remaining-amount indicators 11" unless the colors are distinguished) are disposed at positions corresponding to the mount positions of the ink cartridges 10*k*, 10*c*, 10*m*, and 10*y*, respectively. The remaining-amount indicators 11*k*, 11*c*, 11*m*, and 11*y* indicate that the remaining-amounts of inks in the ink cartridges 10*k*, 10*c*, 10*m*, and 10*y* are at an ink near-empty or empty state. The operation-and-indication portion 5 also includes a power button 12, a sheet-feed and resume button 13, and a cancel button 14.

Figure 2:
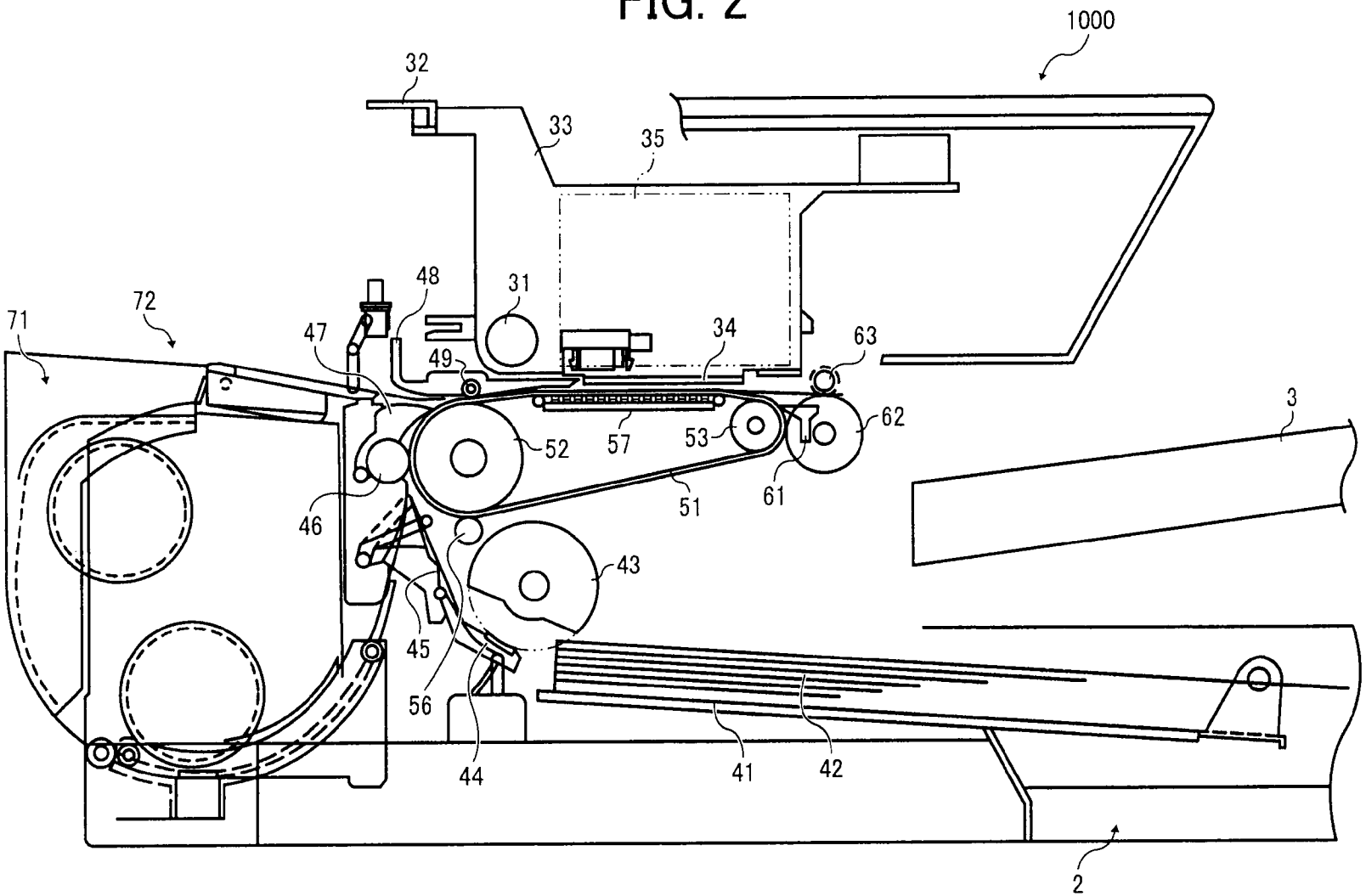
FIG. 2 is a schematic side view illustrating a mechanical configuration of the inkjet recording apparatus.
Figure 3:
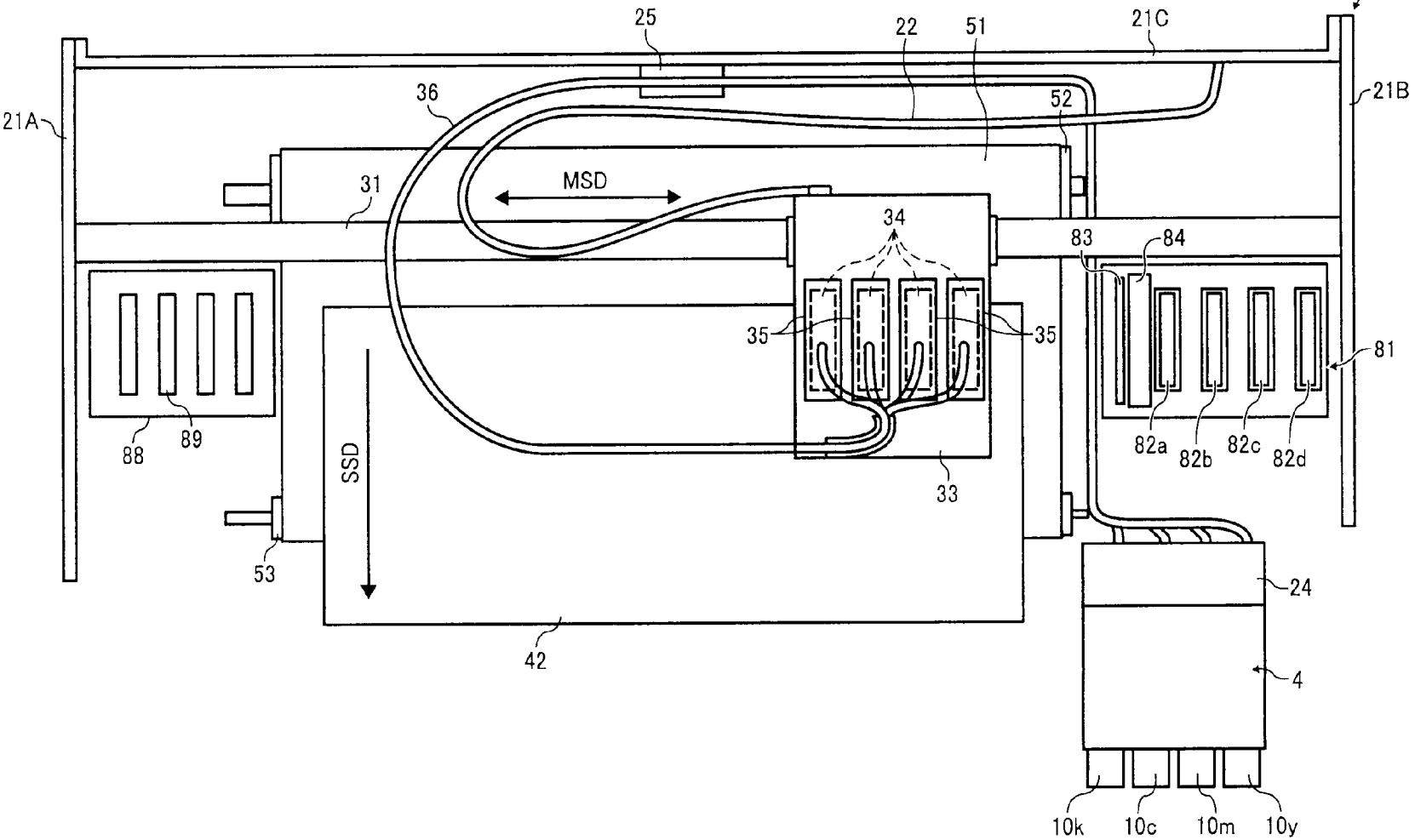
FIG. 3 is a plan view illustrating a portion of the mechanical configuration of FIG. 2.

Next, a description is given of a mechanical configuration of the inkjet recording apparatus 1000 with reference to FIGS. 2 and 3.

FIG. 2 is a schematic side view illustrating the mechanical configuration of the inkjet recording apparatus 1000. FIG. 3 is a plan view illustrating a portion of the mechanical configuration of FIG. 2.

As illustrated in FIGS. 2 and 3, a carriage 33 is slidably supported with a guide rod 31 and a stay 32 in a main scan direction of the carriage 33. The guide rod 31 is laterally disposed between side plates 21A and 21B constituting a frame 21. The carriage 33 is driven by a main-scan motor via a timing belt to scan in the main scan direction, which is a direction indicated by an arrow "MSD" in FIG. 3.

In the carriage 33 are mounted recording heads 34 that are liquid-droplet ejection heads for ejecting different color inks of yellow (Y), cyan (C), magenta (M), and black (K) as described above. Each of the recording heads 34 includes a plurality of ink ejection orifices arranged perpendicular to the main scan direction, and is mounted in the carriage 33 so as to eject droplets of ink downward.

The recording heads 34 may also be liquid-droplet ejection heads including, as a pressure generator to generate pressure for ejecting liquid droplets, a piezoelectric actuator such as a piezoelectric element, a thermal actuator to bring about film boiling within a recording liquid using an electro-thermal conversion element such as a heat-generating resistance body, a shape-memory alloy using metallic-phase change caused by temperature change, or an electrostatic actuator using electrostatic force.

The recording head 34 includes a driver IC (integrated chip) connected to a controller via a harness (flexible print cable) 22.

On the carriage 33 are mounted the recording heads 34 and sub tanks 35 that contain the different color inks supplied to the recording heads 34. The color inks are supplied to the sub tanks 35 through corresponding ink supply tubes 36 from the ink cartridges 10 mounted in the cartridge mount portion 4. The cartridge mount portion 4 includes a supply pump 24 to send ink in the ink cartridges 10. The ink supply tubes 36 are held with a latch member 25 at a rear plate 21C constituting part of the frame 21.

The inkjet recording apparatus 1000 includes a sheet feed roller 43 and a separation pad 44 as a sheet feed section for feeding sheets 42 stacked on a sheet stack portion (platen) 41 of the sheet feed tray 2. The sheet feed roller 43 has, for example, a half-moon shape so as to separate and feed the sheets 42 sheet by sheet from the sheet stack portion 41. The separation pad 44 is made of a material with high friction coefficient and biased toward the sheet feed roller 43.

To send the sheet 42, which is fed from the sheet feed section, below the recording heads 34, the inkjet recording apparatus 1000 further includes a guide member 45 to guide the sheet 42, a counter roller 46, a transport guide member 47, a pressing member 48 with a sheet-end pressing roller 49, and a transport belt 51 to transport the sheet 42 to a position opposed to the recording heads 34 while attracting the sheet 42 thereon with electrostatic force.

The transport belt 51 is an endless belt extending between a transport roller 52 and a tension roller 53 so as to circulate in a direction (belt transport or sub-scan direction) indicated by an arrow "SSD" in FIG. 3. The inkjet recording apparatus 1000 also includes a charge roller 56 to charge the surface of the transport belt 51. The charge roller 56 is disposed so as to be rotated by rotation of the transport belt 51 in contact with an outer surface of the transfer belt 51. At the back side of the transfer belt 51, a guide member 57 is disposed opposed to a print area of the recording heads 34.

The transport roller 52 is driven by a sub-scanning motor via a timing belt so that the transport belt 51 is circulated in a belt transfer direction, i.e., the sub-scan direction "SSD" illustrated in FIG. 3.

The inkjet recording apparatus 1000 further includes a separation hook 61, a first discharge roller 62, and a second discharge roller 63, which constitute a sheet discharge section to discharge the sheet 42 recorded by the recording heads 34. The separation hook 61 separates the sheet 42 from the transfer belt 51, and the discharge rollers 62 and 63 discharge the sheet 42 to the discharge tray 3, which is disposed below the first discharge roller 62.

On the rear side of the apparatus body 1 is detachably mounted a duplex unit 71. The duplex unit 71 receives the sheet 42 sent back by a reverse rotation of the transport belt 51, turns the sheet 42 upside down, and feeds the sheet 42 to a nip portion between the counter roller 46 and the transport belt 51. The top face of the duplex unit 71 is formed as a manual-feed tray 72.

Further, as illustrated in FIG. 3, a maintenance recovery mechanism 81 is provided at a non-print area on one side in the main-scan direction of the carriage 33. The maintenance recovery mechanism 81 includes a recovery unit to maintain and recover nozzles of the recording heads 34.

The maintenance recovery mechanism 81 further includes cap members 82*a*, 82*b*, 82*c*, and 82*d* (hereinafter, may be collectively referred to as "caps 82" unless distinguished) to cap a nozzle surface of each recording head 34, a wiper blade 83 to wipe the nozzle surface of each recording head 34, and a first maintenance-ejection receiver 84 to receive liquid droplets ejected for maintenance to expel recording liquid (ink) with increased viscosity. In this example, the cap 82*a* is used for suction and moisture retention while the other caps 82*b*, 82*c*, and 82*d* are used for suction.

As illustrated in FIG. 3, a second maintenance-ejection receiver 88 is provided at a non-print area on the other side in the main-scanning direction of the carriage 33. The second maintenance-ejection receiver 88 receives liquid droplets ejected for maintenance to expel recording liquid with increased viscosity and is provided with openings 89 arranged along the nozzle-array directions of the recording heads 34.

In the inkjet recording apparatus 1000 thus configured, the sheets 42 are separated from the sheet feed tray 2 and fed sheet by sheet in a substantially vertical direction. The sheet 42 is guided with the guide member 45 and transported between the transport belt 51 and the counter roller 46. The sheet 42 is transported with being sandwiched between the transport belt 51 and the counter roller 46, and a front edge portion of the sheet 42 is guided with the transport guide member 47 and pressed with the sheet-end pressing roller 49 against the transport belt 51, so that the transport direction of the sheet 42 is turned about 90 degrees.

At this time, alternate voltages are applied to the charge roller 56 so that plus and minus outputs are alternately repeated. As a result, the charge roller 56 is charged with a charge-voltage pattern in which the voltage of the transport belt 51 alternates. In other words, on the surface of the charge roller 56, a positively-charged band area and a negatively-charged band are alternately repeated at a certain width in the sub-scanning direction, which is the circulation direction of the transport belt 51. When the sheet 42 is fed onto the alternately-charged transport belt 51, the sheet 42 is attracted to the transport belt 51 and transported in the sub-scanning direction by the rotation of the transport belt 51.

During the travel of the carriage 33, the recording heads 34 are driven in accordance with image signals so that droplets of ink are ejected onto the sheet 42 at a halt. When one line of an image is recorded, the sheet is fed by a predetermined distance to record another line. When a record end signal or a signal indicating that the rear end of the sheet 42 reaches a recording area is received, the recording operation is finished and the sheet 42 is discharged to the discharge tray 3.

In a standby mode, the carriage 33 moves to the maintenance recovery mechanism 81, and the caps 42 cap the recording heads 34 to keep the nozzles of the recording heads 34 moisturized, thus preventing occurrence of an ejection failure due to ink dry. With the recording heads 34 capped with the caps 82, a suction pump sucks recording liquid from the nozzles (so called "nozzle suction" or "head suction") to expel viscosity-increased recording liquid or bubbles as maintenance. Ahead of the start of recording or during recording, a maintenance ejection operation is performed to eject ink, which does not constitute a resultant image, so as to maintain a stable ejection performance of each recording head 34.

Figure 4:
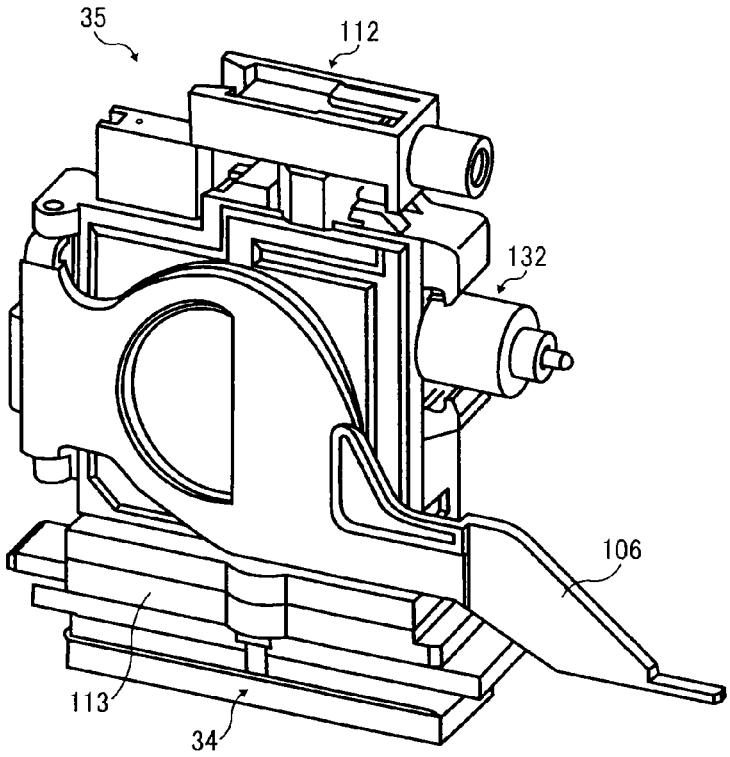
FIG. 4 is a perspective view illustrating an example of a sub tank used in the inkjet recording apparatus.
Figure 5:
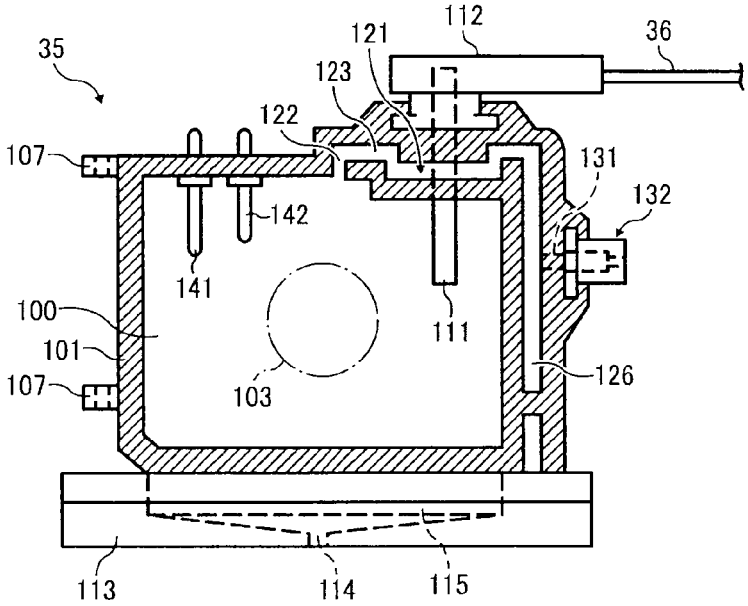
FIG. 5 is a schematic side view illustrating the sub tanks illustrated in FIG. 4.

Next, an example of the sub tank 35 used in the image forming apparatus is described with reference to FIGS. 4 and 5. FIG. 4 is an external perspective view illustrating the sub tank 35. FIG. 5 is a schematic side view illustrating the sub tank 35.

The sub tank 35 includes a container body or case 101 constituting an ink containing portion 100 to contain ink, which is a recoding liquid. On the container body 101 is adhered or welded a flexible film member that seals an opening of the ink containing portion 100 (one side of the sub tank 35). Further, an elastic member 103, such as a spring, that biases the flexible film member outward is provided within the ink containing portion 100.

At one lateral side of the case 101 are provided holders 107, on which a negative-pressure detection lever 106 that displaces depending on the displacement of the flexible film member is pivotably mounted.

The case 101 includes an ink inlet portion 111 to refill ink into the ink containing portion 100. A connection member 112 is detachably mounted on the case 101 to connect the ink inlet portion 111 to a supply tube 36, which is connected to the ink cartridge 10.

At a bottom portion of the case 101 is mounted a coupling member 113 to supply ink from the ink containing portion 100 to the recording head 34. An ink supply path 114 of the recording head 34 is formed within the coupling member 113, and a filter 115 is provided between the ink supply path 114 and the ink containing portion 100.

At an upper portion of the case 101 is formed an airflow channel 121 to flow air from the ink containing portion 100. The airflow channel 121 includes an inlet channel portion 122, which is an opening leading to the ink containing portion 100, and a channel portion 123 leading to the inlet channel portion 122. The airflow channel 121 is communicated with an air release hole 131, which is formed in the case 101 at the downstream side of the airflow channel 121, and includes an accumulation portion 126 at a portion lower than the air release hole in the state of use.

At the airflow release hole 131 is provided an air-release valve mechanism 132 to switch between air-release and closed states of the sub tank 35. The air-release valve mechanism 132 has a holder including a valve seat, a ball serving as a valve disc, and a spring that biases the ball toward the valve seat.

At an upper portion of the case 101 are mounted two detection electrodes 141 and 142 to detect that the amount of gas (air) in the sub tank 35 exceeds a threshold or the amount of ink remaining in the sub tank 35 falls short of a threshold. The conduction state between the detection electrodes 141 and 142 varies between a state in which both the detection electrodes 141 and 142 are immersed in ink and a state in which at lease one of the detection electrodes 141 and 142 is not immersed in ink. Thus, the mount of gas or ink can be detected with the detection electrodes 141 and 142.

Figure 6:
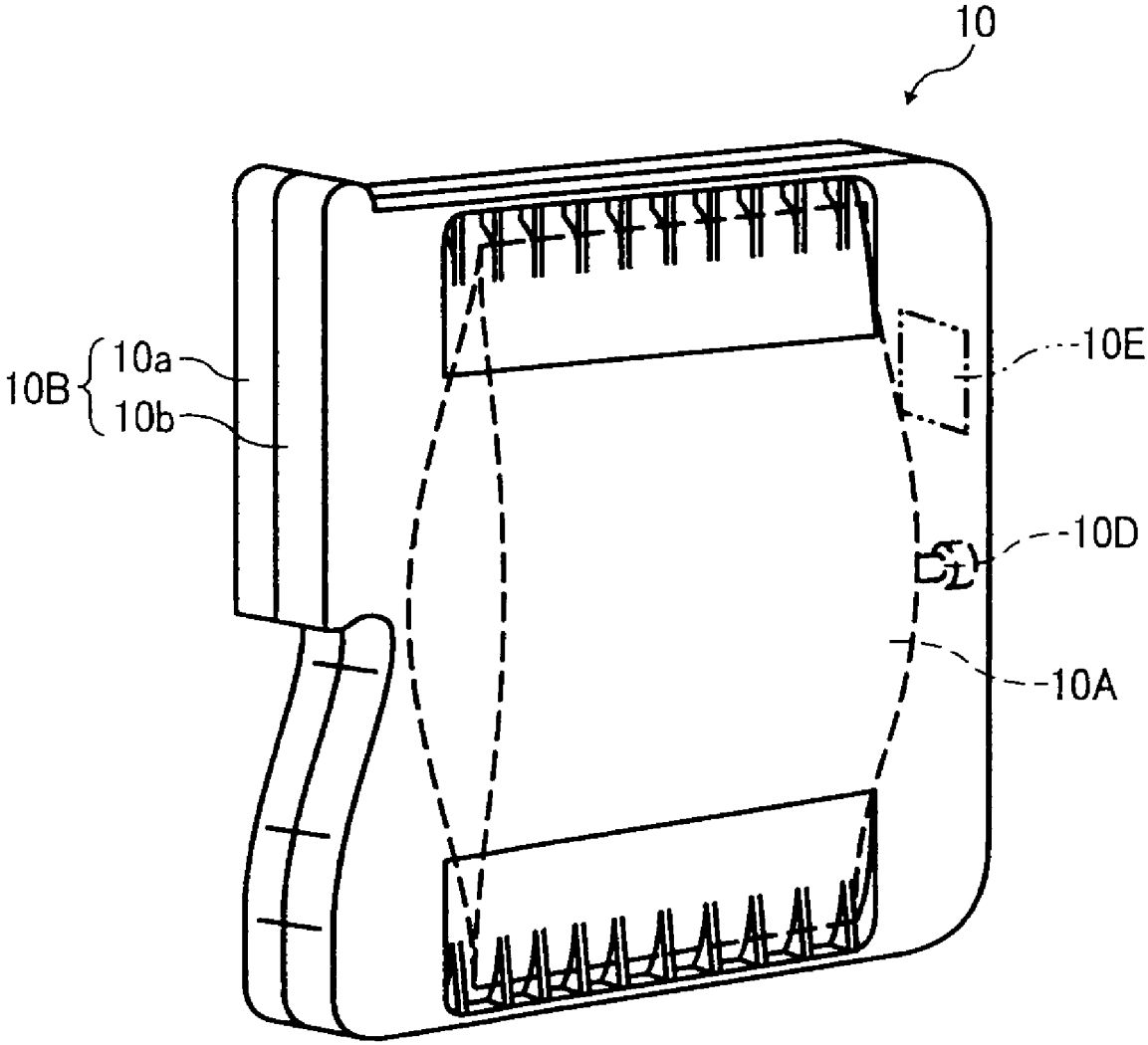
FIG. 6 is a perspective view illustrating a configuration of an ink cartridge.

FIG. 6 is a perspective view illustrating an example of the ink cartridge 10 mounted in the cartridge mount portion 4.

The ink cartridge 10 includes an ink bag 10A to contain a certain color ink and a housing 10B removably housing the ink bag 10A. The housing 10B includes a first housing portion 10*a* and a second housing portion 10*b*, which are separatable into at least two pieces. The first housing portion 10*a* and the second housing portion 10*b* constitute a housing portion serving as a protection cover to protect side faces of the ink bag 10A. In other words, the housing 10B can be separated into the first housing portion 10*a* and the second housing portion 10*b*, which house the ink bag 10A, along a plane parallel to a direction in which ink is supplied from the housing 10B.

The ink bag 10A has an ink supply port 10D, which is connected to a supply needle provided at a back side of the cartridge mount portion 4 when the ink bag 10A is mounted in the cartridge mount portion 4 of the apparatus body 1. On the back face of the housing 10B, which is the face having the ink supply port 10D, is provided a nonvolatile memory 10E, such as EEPROM (electrically erasable programmable read only memory), to store specific information on the ink cartridge 10. When the ink cartridge 10 is mounted in the cartridge mount portion 4, the nonvolatile memory 10E is electrically connected to an apparatus-side electrode provide at the back side of the cartridge mount portion 4, so that such specific information stored on the nonvolatile memory 10E is loaded on a controller of the apparatus body 1.

Such specific information stored on the nonvolatile memory 10E includes, for example, information on color, remaining amount of ink, and use-by date of the ink cartridge 10 and is rewritable from the apparatus body 1.

It is to be noted that it depends on the conditions of the recording head 34 and the sub tank 35 whether or not printing is normally performed. Below, a description is given of three examples of failures, that is, air bubbles, air leak, and nozzle failure.

[1] Air Bubbles

In the inkjet recording apparatus 1000 illustrated in FIG. 1, the ink cartridge 10 is connected to the sub tank 35 via the ink supply tube 36. In this regard, for example, if the supply pump unit 24 continues suction operation after the ink bag 10A of the ink cartridge 10 runs out of ink, air is sucked from a connection portion, which is provided between the supply needle and the ink bag 10A at the back side of the cartridge mount portion 4, and transported to the sub tank 35. As a result, such air may bubble ink in the ink cartridge 10, thereby generating air bubbles within the ink containing portion 100. In such a case, if such bubbles are ejected together with ink from the recording head 34, a printed image may be inadvertently degraded.

Hence, according to the present illustrative embodiment, such bubbles can be detected with the detection electrodes 141 and 142 of the sub tank 35. For example, if a lowering of the surface level of ink is detected with the detection electrodes 141 and 142 while a sufficient amount of ink remains in the ink containing portion 100 of the sub tank 35, the inkjet recording apparatus 1000 determines that the ink containing portion 100 includes air bubbles.

Further, according to the present illustrative embodiment, when such air bubbles are detected, the inkjet recording apparatus 1000 executes maintenance, which is referred to as "pumping sequence", to remove air bubbles. Specifically, the carriage 33 is moved to the maintenance recovery mechanism 81, and the nozzle surface of a target recording head 34 is capped with the corresponding cap 82. With the ink containing portion 100 being closed, the inkjet recording apparatus 1000 sucks ink with the cap 82 while supplying ink from the ink cartridge 10, thus ejecting ink from the recording head 34 for maintenance. Such maintenance ejection to remove air bubbles may consume a relatively large amount of ink supplied from the ink cartridge 10 compared to the maintenance ejection for air leak or nozzle failure described below.

[2] Air Leak

The sub tank 35 constantly maintains a negative pressure greater than a threshold to prevent ink from exuding or drooping from nozzles of the recording head 34. In the inkjet recording apparatus 1000 illustrated in FIG. 1, air is more likely to flow into the sub tank 35 compared to another type of inkjet recording apparatus in which an ink cartridge is directly mounted on a recording head. This is because the inkjet recording apparatus 1000 includes, for example, a connection portion such as the connection member 112 that connects the ink inlet portion 111 with the ink supply tube 36 to supply ink from the apparatus body 1. If air flows into the sub tank 35, the internal pressure of the recording head 34 turns into a positive pressure state, resulting in a degraded image quality due to a reduced droplet-ejection performance or leakage of ink from the recording head 34 due to the weight of ink.

Hence, according to the present illustrative embodiment, the sub tank 35 is provided with the negative-pressure detection lever 106 to detect a negative pressure state within the sub tank 35. The negative-pressure lever 106 varies with the negative pressure state of the sub tank 35. When the negative pressure state within the sub tank 45 is unusual, the negative-pressure detection lever 106 is pivoted away from one side of the sub tank 35, which is the home position of the lever 106. That is, the negative-pressure detection lever 106 is pushed outward by the restoring force of the elastic member 103 into an open state. Thus, such an unusual negative pressure is detected by sensing an opened amount of the negative-pressure detection lever 106 with a sensor. Alternatively, a pressure sensor for detecting a pressure within the ink containing portion 100 may be provided to detect an usual negative pressure within the sub tank 35.

According to the present illustrative embodiment, detecting an unusual negative pressure results in a determination that an air leak has been detected, and maintenance (negative-pressure restore operation), which is also referred to as "refreshing process", to restore the unusual negative pressure to a normal state. In the refreshing process, an air-release-and-infilling operation is performed on the sub tank 35 to restore the negative pressure into a normal state. That is, the air release mechanism 132 of the sub tank 35 is turned into an open state to release air from the sub tank 35. In this state, the supply pump 24 is activated to supply (refill) ink from the ink cartridge 10 to the sub tank 35. In such a case, the ink refill operation is started with the sub tank 35 being held at a position such that the negative-pressure detection lever 106 can be detected with the sensor when the sub tank 35 is filled up with ink and finished when the negative-pressure detection lever 106 is detected with the sensor. Then, with the recording head 34 being capped with the cap 82*a*, the suction pump is activated to suck a certain amount of ink from the nozzles of the recording head 34, so that the inside of the sub tank 35 is turned into a certain negative pressure state by the restoration force of the elastic member 103 (in this case, the negative pressure state is newly generated). Thus, such an unusual negative pressure of the sub tank 35 is restored into a normal state.

The amount of ink consumed in this type of maintenance process (refreshing), which is the amount of ink supplied from the ink cartridge, is the second largest for the above-described three examples of failures.

[3] Nozzle Failure

In the recording head 34, adherence of ink residue or dust around a nozzle may result in a skew in a direction in which ink is ejected from the nozzle, or the dry of ink at a nozzle may result in clogging or other ejection failures of ink. A cleaning (maintenance) process need be regularly executed to prevent such failures.

Hence, according to the present illustrative embodiment, the inkjet recording apparatus 1000 measures an elapsed time from previous refreshing of a target one of the recording heads 34 and performs a predetermined maintenance process, such as refreshing or cleaning, in accordance with the elapsed time. For example, when the elapsed time is not more than a threshold time, the carriage 33 is moved to the maintenance recovery mechanism 81 to cap the target recording head 34 with the corresponding cap 82 once per a predetermined number of printed pages during execution of print job (image formation). With the ink containing portion 100 being closed without executing air release, the inkjet recording apparatus 1000 sucks ink with the cap 42 while supplying ink from the ink cartridge 10, thus ejecting ink from the recording head 34 for maintenance. The amount of ink consumed in this maintenance process, which is supplied from the ink cartridge 10, is the least for the above-described three examples of failures.

In the above-described case, if the elapsed time exceeds a threshold, the refreshing process is executed.

Next, a description is given of control of maintenance in the inkjet recording apparatus 1000 illustrated in FIG. 1.

In FIG. 1, the inkjet recording apparatus 1000 includes the plurality of ink cartridges 10 each containing ink and having the nonvolatile memory 10E constituting a memory on which information is rewritable and updatable, the recording heads 34 and the sub tanks 35 constituting a plurality of image forming units to form images with ink contained in the corresponding ink cartridges 10, an ejected-droplet counter 202, an ink-consumption-amount processing unit 203, and an ink-remaining-amount calculation unit 208 constituting an ink-remaining-amount manager to manage information on the amount of ink remaining in each of the ink cartridges 10, a maintenance sequence prediction unit 206 constituting a maintenance determiner to determine at least one of a need for or a type of maintenance for each of the plurality of image forming units, and a cartridge control unit 212 constituting an information writer to write or update information indicating that the one ink cartridge 10 is spent on the memory of the one ink cartridge 10 whenever one of the ink cartridges 10 is in an ink near-empty or empty state.

The inkjet recording apparatus 1000 also includes a maintenance-executability determination unit 207 constituting an ink amount estimator to estimate the amount of ink required to execute maintenance on each of the ink cartridges 10 and a maintenance executability determiner to compare the ink remaining amount obtained from the ink-remaining-amount manager to the required ink amount obtained from the ink amount estimator to determine whether or not maintenance is executable for each of the ink cartridges 10.

When image formation causes an ink near-empty or empty state in one of the ink cartridges 10, the ink amount estimator estimates the amount of ink required to maintain each of the other ink cartridges 10 based on a determination result of at least one of the need for maintenance for the plurality of image forming units and the type of maintenance executed on each of the other ink cartridges 10 when the error ink cartridge 10 is replaced, which is determined by the maintenance determiner. If for one of the other ink cartridges 10 it is determined that maintenance is not executable based on both the estimated required ink amount and the remaining ink amount, the maintenance-executability determiner determines that the unexecutable ink cartridge 10 is at an ink near-empty or empty state and, at the same time, stops writing or updating the information indicative of the spent state on the memory of the unexecutable ink cartridge 10 using the information writer.

Below, a detailed description of the above-described process is given with reference to the drawings.

Figure 7:
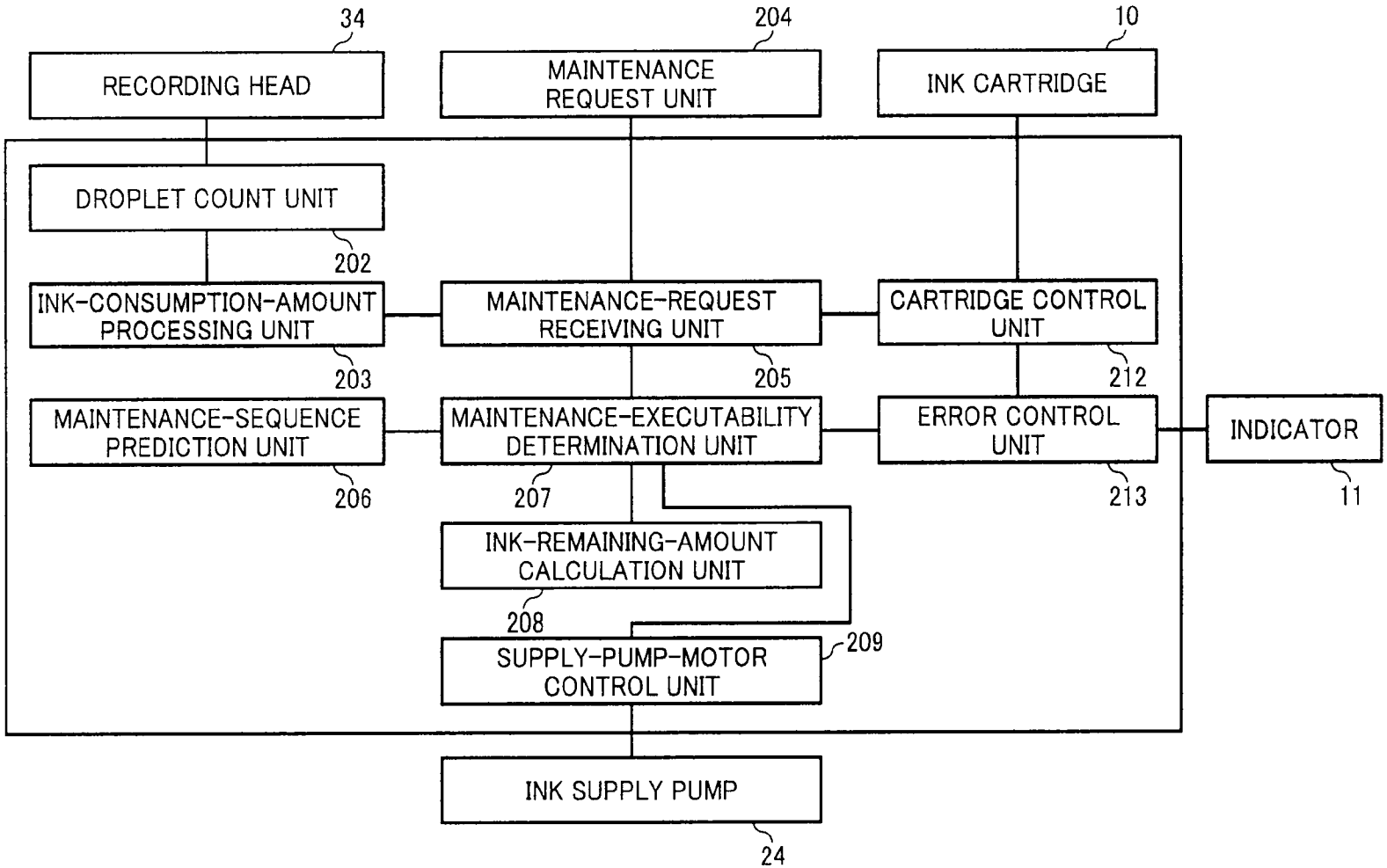
FIG. 7 is a block diagram illustrating components for executing maintenance in the inkjet recording apparatus illustrated in FIG. 1.

FIG. 7 is a block diagram illustrating components for executing maintenance in the inkjet recording apparatus 1000 illustrated in FIG. 1.

The recording heads 34 eject ink in accordance with data processed in a print-data processing unit to form an image on a sheet or recording medium. At this time, the ejected-droplet counter 202 counts the amount or number of droplets of ink ejected from the recording heads 34 in forming the image. Based on the amount of ink counted at the ejected-droplet counter 202, the ink-remaining-amount calculation unit 208 calculates the amount of ink remaining in the ink cartridge 10. In detecting the ink remaining amount, information on the amount of ink remaining in the ink cartridge 10 at that time, which is stored on the nonvolatile memory 10E of the ink cartridge 10, is read and temporarily stored on a nonvolatile memory in the apparatus body 1. The ink-consumption-amount processing unit 203 updates the remaining ink amount of the ink cartridge 10 managed in the inkjet recording apparatus 1000 and determines execution of ink supply to the sub tank 35. An updated remaining ink amount obtained based on the remaining ink amount and the ink consumption amount is written on the nonvolatile memory 10E of the ink cartridge 10 each time printing is performed or each time ink is refilled from the ink cartridge 10 to the sub tank 35. Thus, the remaining ink amount stored on the nonvolatile memory 10E of the ink cartridge 10 is read to detect that the ink cartridge 10 is, for example, out of ink (at the ink near-empty or empty state).

[In Ink Supply]

If the ink-consumption-amount processing unit 203 determines that ink must be supplied to the sub tank 35, the ink-consumption-amount processing unit 203 transmits a request for an ink supply operation to a maintenance-request receiving unit 205.

When receiving the request of the ink supply operation, the maintenance-request receiving unit 205 queries the maintenance-executability determination unit 207 regarding executability of maintenance (ink supply). The maintenance-executability determination unit 207 determines the executability of maintenance based on the remaining ink amount of the ink cartridge 10 retained in the ink-remaining-amount calculation unit 208. If the maintenance-executability determination unit 207 determines that maintenance is executable, a supply-pump-motor control unit 209 activates an ink supply pump 210 to supply a predetermined amount of ink to the sub tank 35.

[When Maintenance Process is Requested]

When a maintenance request unit 204 sends a request for executing maintenance (cleaning, refreshing, or pumping sequence) on the image forming units implemented by the recording heads 34 and the sub tanks 35, the maintenance-request receiving unit 205 receives the request and queries the maintenance-executability determination unit 207 regarding executability of maintenance. The maintenance-executability determination unit 207 compares the amount of ink required to execute maintenance to the remaining ink amount of the ink cartridge 10 retained in the ink-remaining-amount calculation unit 208 and determines the executability of maintenance.

If the maintenance-executability determination unit 207 determines that maintenance is executable, the inkjet recording apparatus 1000 executes maintenance and the supply-pump-motor control unit 209 activates the ink supply pump 210 to supply a certain amount of ink to the sub tank 35.

If the maintenance-executability determination unit 207 determines that maintenance is not executable, the maintenance-executability determination unit 207 reports to an error control unit 213 the occurrence of the ink near-empty or empty error in the unexecutable ink cartridge 10.

To inform a user that the unexecutable ink cartridge 10 is at the ink near-empty or empty state, the error control unit 213 instructs the corresponding remaining-amount indicator (or panel) 11 to indicate the ink near-empty or empty state. When the cartridge control unit 212 receives such information indicative of the ink near-empty or empty error from the error control unit 213, the cartridge control unit 212 stops executing processing of making unusable the unexecutable ink cartridge 10, which is expected to run short of ink due to maintenance, that is, stops writing or updating information indicative of the spent state on the nonvolatile memory 10E of the unexecutable ink cartridge 10.

When the ink cartridge 10 in the ink near-empty or empty error is replaced, the cartridge control unit 212 requests the maintenance-request receiving unit 205 to execute a maintenance sequence requested from the maintenance request unit 204. The maintenance-request receiving unit 205 identifies the type of maintenance sequence and queries the maintenance-executability determination unit 207 regarding executability of maintenance.

If the maintenance-executability determination unit 207 determines maintenance is executable, the inkjet recording apparatus 1000 executes maintenance. When maintenance ends, the error control unit 213 cancels the error status indicated in the remaining-amount indicator 11.

[When an Ink Cartridge Runs Short of Ink Due to Image Formation]

In supplying ink from one of the ink cartridges 10 to the corresponding sub tank 35 during printing (image formation), if the maintenance-executability determination unit 207 determines that a sufficient amount of ink required to execute the ink supply operation does not remain in the ink cartridge 10 (that is, an ink near-empty or empty error occurs in the ink cartridge 10), the maintenance-sequence prediction unit 206 selects a maintenance sequence predicted to be executed in connection with the replacement of the ink cartridge 10. If the selected maintenance sequence is a maintenance sequence in which ink is supplied from one of the other ink cartridges 10 except the first error ink cartridge 10 being out of ink or in the ink near-empty or empty error supplies ink, the maintenance-executability determination unit 207 confirms with the ink-remaining-amount calculation unit 208 whether or not a sufficient amount of ink required to execute maintenance remains in each of the other ink cartridges 10 based on the estimated required ink amount.

At this time, if the maintenance-executability determination unit 207 determines that a sufficient amount of ink required to execute the predicted maintenance sequence remains in one of the other ink cartridges 10, the maintenance-executability determination unit 207 identifies the color of the first error ink cartridge 10 in the ink near-empty or empty error and reports the occurrence of the error to the error control unit 213.

To inform a user that the first error ink cartridge 10 is in the ink near-empty or empty state, the error control unit 213 instructs the corresponding remaining-amount indicator (panel) 11 to indicate the ink near-empty or empty state. When the cartridge control unit 212 receives such information on the ink near-empty or empty error from the error control unit 213, the cartridge control unit 212 writes or updates the information indicative of the spent state on the nonvolatile memory 10E of the first error ink cartridge 10 to execute processing for making the first error ink cartridge 10 unusable.

Alternatively, if the maintenance-executability determination unit 207 determines that a sufficient amount of ink required to execute the predicted maintenance sequence does not remain in one of the other ink cartridges 10, the maintenance-executability determination unit 207 reports to the error control unit 213 the color of the second error ink cartridge 10 as well as the color of the first error ink cartridge 10 and that the second error ink cartridge 10 is also at an ink near-empty or empty state.

To inform a user that the first error ink cartridge 10 and the second error ink cartridge are both in the ink near-empty or empty state, the error control unit 213 instructs the corresponding remaining-amount indicators (e.g., display panels) 11 to indicate the ink near-empty or empty state. When the cartridge control unit 212 receives such information on the ink near-empty or empty error from the error control unit 213, the cartridge control unit 212 writes or updates the information indicative of the spent state on the nonvolatile memory 10E of the first error ink cartridge 10 to execute processing for making the first error ink cartridge 10 unusable. Meanwhile, on the second error ink cartridge 10 expected to run short of ink due to maintenance, the cartridge control unit 212 does not execute processing for making the second error ink cartridge 10 unusable, that is, stops writing or updating information indicative of the spent state on the nonvolatile memory 10E of the second error ink cartridge 10.

When the above-described error ink cartridges 10 in the ink near-empty or empty error are replaced, the cartridge control unit 212 requests the maintenance-request receiving unit 205 to execute a maintenance sequence for cartridge replacement. The maintenance-request receiving unit 205 identifies the type of maintenance sequence and queries the maintenance-executability determination unit 207 regarding executability of maintenance.

If the maintenance-executability determination unit 207 determines that maintenance is executable, the inkjet recording apparatus 1000 executes maintenance. When maintenance is finished, the error control unit 213 cancels the error status indicated in the remaining-amount indicator 11.

Below, a description is given of a maintenance-executability determination process, including an ink-amount estimation process, that the maintenance sequence prediction unit 206 and the maintenance-executability determination unit 207 execute for each of the other ink cartridges 10 when the first error ink cartridge 10 falling short of ink during image formation is replaced.

Figure 8:
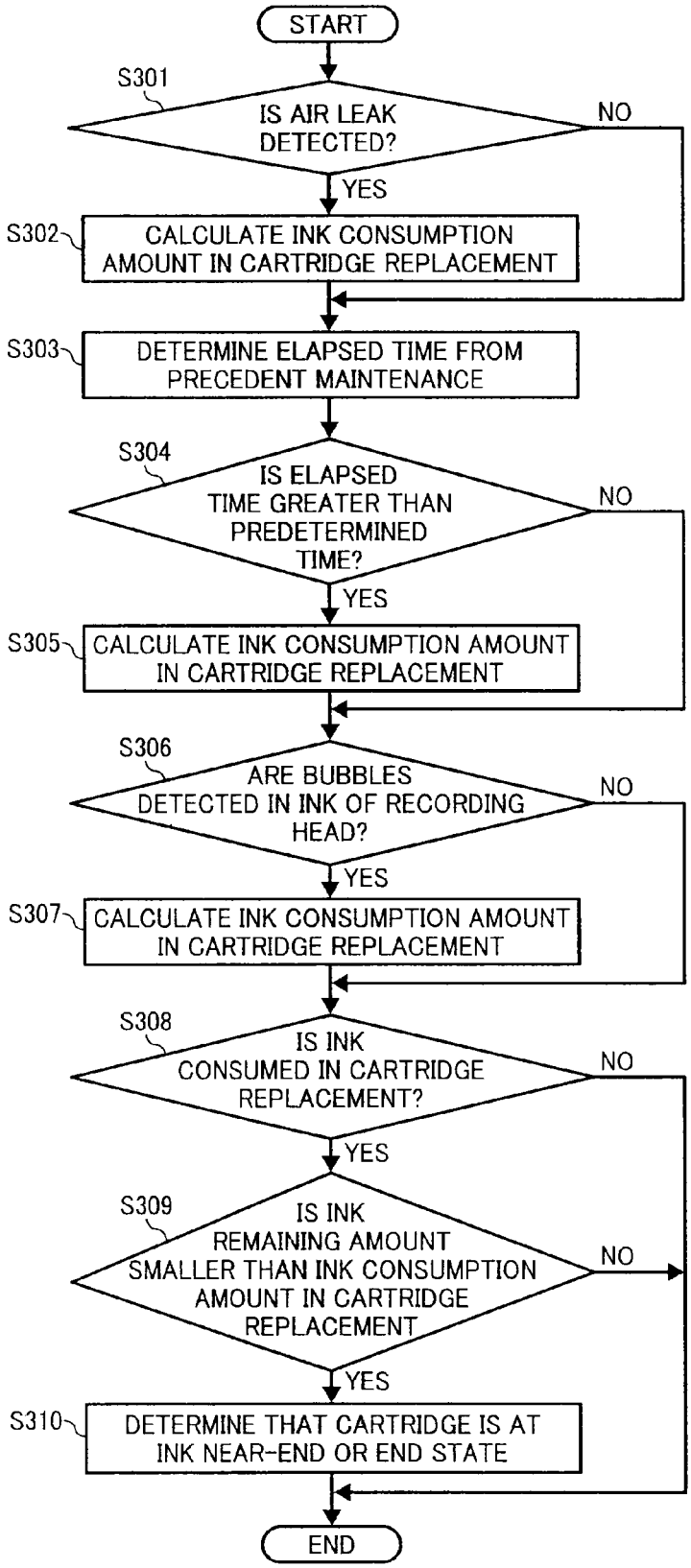
FIG. 8 is a flow chart illustrating a maintenance-executability determination process, including an ink-amount estimation process, executed when the required ink amount is optimally estimated.

FIG. 8 is a flow chart illustrating the maintenance-executability determination process, including an ink-amount estimation process, executed when the amount of ink required to execute the maintenance sequence is optimally estimated.

In the optimal estimation of the required ink amount, the amount of ink required for the cartridge replacement is obtained by acquiring the current status of the inkjet recording apparatus 1000 (or the image forming units) and predicting a maintenance sequence executed in connection with the cartridge replacement. In such a case, if a drastic change occurs in a time period from the occurrence of the ink near-empty or empty error in the first error ink cartridge 10 to the cartridge replacement, an unexpected ink near-empty or empty error might occur in the other ink cartridges 10 due to maintenance executed in connection with the cartridge replacement. However, since such an error rarely occurs, the above-described prediction method is applicable to a normal situation.

[S301] At S301, the maintenance sequence prediction unit 206 confirms whether or not an air leak is present in the sub tank 35 (of the recording head 34) corresponding to the error ink cartridge 10 in the ink near-empty or empty error (detection of air leak state). The detection is performed because, if such an air leak is present, a maintenance sequence (e.g., refreshing) consuming a relatively large amount of ink is selected for all of the ink cartridges 10 as the maintenance sequence executed in connection with the cartridge replacement. Alternatively, if no air leak is present ("No" at S301), a maintenance sequence for servicing only the error ink cartridge 10 in the ink near-empty or empty error is selected, thus preventing ink from being wasted in the other ink cartridges 10.

[S302] If an air leak is present ("YES" at S301), at S302 the maintenance-executability determination unit 207 sets the amount of ink consumed from the other normal ink cartridges 10 by refreshing in the cartridge replacement to an estimated ink amount or a predetermined ink amount, and accounts for the ink consumption amount as the amount of ink required for the replacement of the error ink cartridge 10.

[S303] At S303, the maintenance sequence prediction unit 206 measures an elapsed time from previous maintenance or refreshing (detection of nozzle state).

[S304] In the replacement operation of ink cartridges, at S304 the maintenance sequence prediction unit 206 calculates an elapsed time from previous refreshing for each of the ink cartridges 10 and checks whether or not a predetermined time (threshold) has elapsed. If the predetermined time has elapsed ("YES" at S304), the refreshing process is selected as maintenance in connection with the cartridge replacement. In such a case, as described above, ink of the other ink cartridges 10 as well as ink of the error ink cartridge 10 may be consumed. Alternatively, if the predetermined time has not elapsed ("NO" at S304), the above-described maintenance process (refreshing) is not selected and, as a result, no ink is consumed in maintenance.

[S305] If the predetermined time has elapsed since previous maintenance or refreshing ("YES" at S304), at S305 the maintenance-executability determination unit 207 sets the amount of ink consumed from the other normal ink cartridges 10 by refreshing in the cartridge replacement to an estimated ink amount or a predetermined ink amount, and accounts for the ink consumption amount as the amount of ink required for the replacement of the error ink cartridge 10.

[S306] At S306, the maintenance sequence prediction unit 206 confirms whether or not air bubbles are present in the ink containing portions of the sub tanks 35 of the recording heads 34 (detection of air-bubble occurrence state). If printing is performed with air bubbles present in the ink containing portion, for example, ink might not be normally ejected. Hence, according to the present illustrative embodiment, maintenance (pumping sequence) is executed to remove such air bubbles from the ink containing portion of the relevant sub tank 25. If no air bubbles are present ("NO" at S306), maintenance (pumping sequence) is not selected and no ink is consumed in maintenance.

If air bubbles are present ("YES" at S306), at S307 the maintenance-executability determination unit 207 sets the amount of ink consumed from the other normal ink cartridges 10 by the pumping sequence of the cartridge replacement to an estimated ink amount or a predetermined ink amount and accounts for the ink consumption amount as the amount of ink required for the replacement of the error ink cartridge 10.

The process up to S307 can predict whether or not ink of the other ink cartridges 10, except the error ink cartridge 10 in the ink near-empty or empty state, is consumed in the cartridge replacement.

[S308] In the cartridge replacement, at S308 the maintenance-executability determination unit 207 confirms whether or not ink in each of the other ink cartridges 10 is consumed in the cartridge replacement based on the required ink amount accumulated up to S308. If the required ink amount is zero, i.e., no ink is expected to be consumed ("NO" at S308), the other ink cartridges 10 are still usable. Accordingly, the maintenance-executability determination unit 207 determines that processing corresponding to the ink near-empty or empty error should be executed only on the error ink cartridge 10 in the ink near-empty or empty error and finishes this determination process.

In the cartridge replacement, if ink is expected to be consumed from the other ink cartridges 10 except the error ink cartridge 10 in the ink near-empty or empty error ("YES" at S308), at S309 the maintenance-executability determination unit 207 compares the remaining ink amount of each of the other ink cartridges 10 subjected to maintenance calculated in the ink-remaining-amount calculation unit 208 to the ink amount required for the cartridge replacement estimated in this determination process. If the remaining ink amount of each of the other ink cartridges 10 is not less than the ink amount required for the cartridge replacement ("NO" at S309), the other ink cartridges 10 are still usable. Accordingly, the maintenance-executability determination unit 207 determines that processing corresponding to the ink near-empty or empty error should be executed only on the error ink cartridge 10 in the ink near-empty or empty error and finishes this determination process.

[310] If the remaining ink amount of one of the other ink cartridges 10 is less than the ink amount required for the cartridge replacement ("YES" at S309), the maintenance-executability determination unit 207 determines that the relevant ink cartridge 10 is at the ink near-empty or empty state and executes a predetermined error process (e.g., indicates the ink near-empty or empty error on the remaining-amount indicator 11 and stops writing or updating the information indicative of the spent state on the nonvolatile memory 10E).

Figure 9:
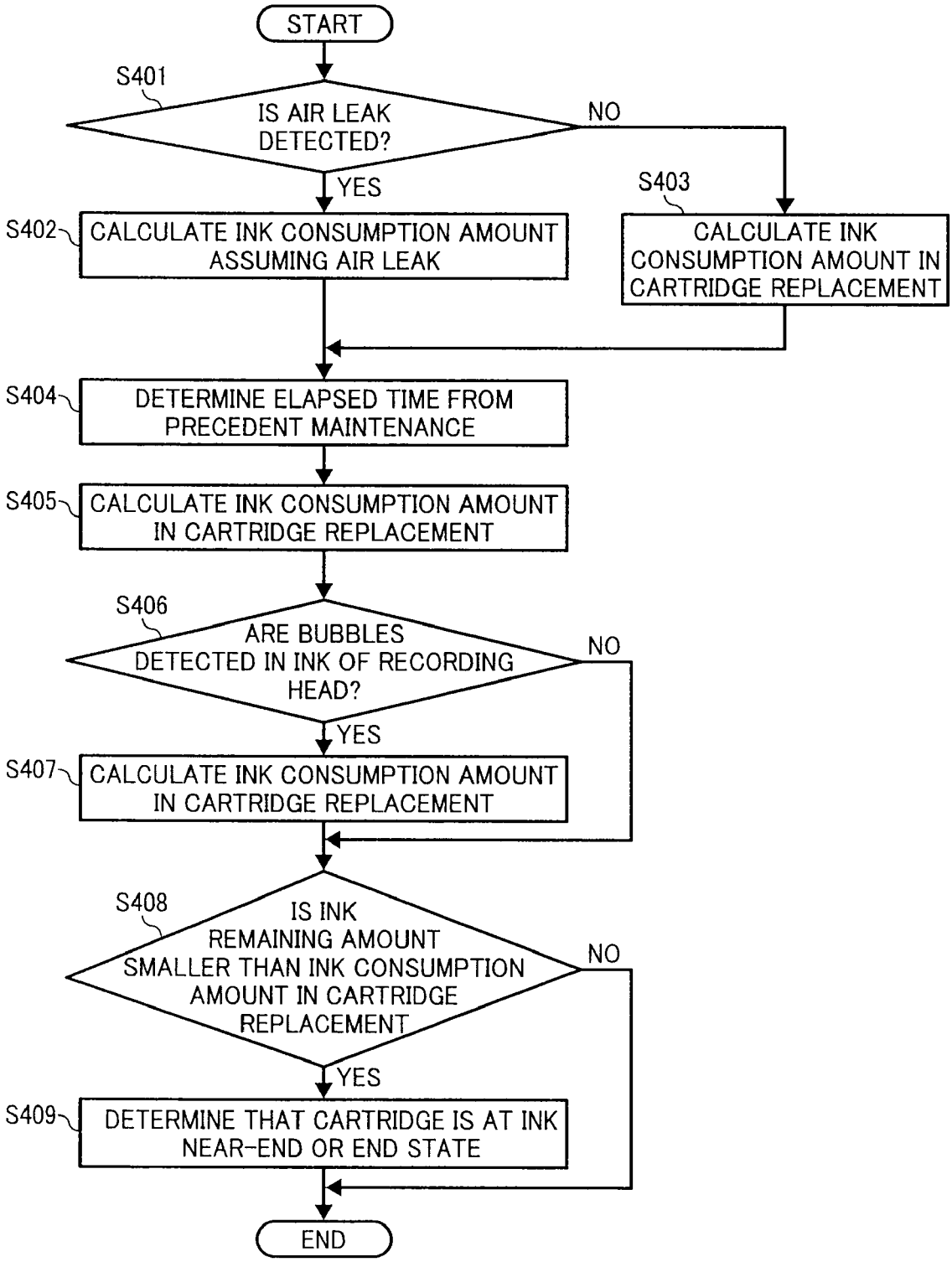
FIG. 9 is a flow chart illustrating a maintenance-executability determination process, including an ink-amount estimation process, executed when the amount of ink required for cartridge replacement is estimated taking into account estimated time to cartridge replacement.

FIG. 9 is a flow chart illustrating a maintenance-executability determination process, including an ink-amount estimation process, executed when the amount of ink required for cartridge replacement is estimated taking into account estimated time to cartridge replacement.

In such estimation, determination of the ink near-empty or empty error in the other ink cartridges 10 is performed under stricter conditions than when the ink near-empty or empty error occurs in the first error ink cartridge 10 so that no ink near-empty or empty error occurs during execution of maintenance after the cartridge replacement of the first error ink cartridge 10. In a usual situation, such an estimation method may inadvertently result in an increased occurrence of ink near-empty or empty error. Meanwhile, the estimation method is suitable for an unusual situation, for example, one in which it would take a long time to obtain a replacement ink cartridge 10 after occurrence of such an error or it would be difficult to obtain a replacement ink cartridge 10 when such an error occurs during the cartridge replacement.

[S401] At S401, the maintenance sequence prediction unit 206 confirms whether or not an air leak is present in the sub tank 35 (of a recording head 34) corresponding to one of the ink cartridges 10 in an ink near-empty or empty error (detection of air leak state). The detection is performed because, if an air leak is present, a maintenance sequence (refreshing process) consuming a relatively large amount of ink is selected for all of the ink cartridges 10 as the maintenance sequence executed with cartridge replacement.

[S402] If an air leak is present ("YES" at S401), the maintenance-executability determination unit 207 determines that, even if the sub tank 35 is left for a long time until the error ink cartridge 10 is replaced, the air leak would not disappear in the sub tank 35 and therefore the state of the sub tank 35 (or the recording head 35) would become neither better nor worse. Accordingly, a predetermined amount of ink is estimated to be consumed in the cartridge replacement. At S402, the ink consumption amount consumed by the refreshing process in the other ink cartridges 10 except the error ink cartridge 10 is set to an estimated ink amount or a predetermined ink amount, and accounted for as the amount of ink required for the cartridge replacement of the error ink cartridge 10.

Alternatively, in the case in which no air leak currently is present ("NO" at S401), if the error ink cartridge 10 is left for a long time until it is replaced, air is more likely to flow into the error ink cartridge 10. Therefore, the maintenance-executability determination unit 207 uses a predetermined ink consumption amount for cartridge replacement as the estimated ink consumption amount and accounts for the estimated ink consumption amount as the amount of ink required for the replacement of the error ink cartridge 10. Such an estimated ink consumption amount may be equal to or slightly less than the ink consumption amount in the case in which an air leak is present.

[S404] At S404, the maintenance sequence prediction unit 206 measures an elapsed time from previous maintenance or refreshing (detection of nozzle state).

[S405] In the cartridge replacement, at S405 the maintenance sequence prediction unit 206 calculates an elapsed time from previous maintenance for each of the ink cartridges 10 and additionally estimates a time (estimated replacement time) to replacement of each of the ink cartridges 10. Taking into account the estimated replacement time, the maintenance sequence prediction unit 206 further calculates the amount of ink consumed in connection with the cartridge replacement and accounts for the ink consumption amount as the amount of ink required for the replacement of the target ink cartridge 10.

[S406] At S406, the maintenance sequence prediction unit 206 confirms whether or not air bubbles are present in the ink containing portions of the sub tanks 35 of the recording heads 34 (detection of air-bubble occurrence state). If no air bubbles are present ("NO" at S406), maintenance is not selected and no ink is consumed in maintenance.

[S407] In the case in which air bubbles are present ("YES" at S406), if the sub tank 35 is left for a long time until the ink cartridge 10 is replaced, air bubbles in the sub tank 35 may disappear, resulting in a reduced amount of ink required for the cartridge replacement. Hence, even if air bubbles are present in the sub tank 35 (of the recording head 24), at S407 the maintenance-executability determination unit 207 estimates an actually-required ink consumption amount taking into account the time (estimated replacement time) to cartridge replacement and accounts for the ink consumption amount as the amount of ink required for the cartridge replacement.

Such process can predict whether or not ink of the other ink cartridges 10 except the error ink cartridge 10 in the ink near-empty or empty error is consumed when the error ink cartridge 10 is replaced after a long time.

[S408] At S408, the maintenance-executability determination unit 207 compares the remaining ink amount of each of the other ink cartridges 10 subjected to maintenance calculated in the ink-remaining-amount calculation unit 208 to the ink amount required for the cartridge replacement estimated in this determination process. If the remaining ink amount of each of the other ink cartridges 10 subjected to maintenance is not less than the ink amount required for the cartridge replacement ("NO" at S408), the other ink cartridges 10 subjected to maintenance are still usable. Accordingly, the maintenance-executability determination unit 207 determines that processing corresponding to the ink near-empty or empty error should be executed only on the error ink cartridge 10 in the ink near-empty or empty error and finishes this determination process.

[S409] If the remaining ink amount of each of the other ink cartridges 10 subjected to maintenance is less than the ink amount required for the cartridge replacement ("YES" at S408), the maintenance-executability determination unit 207 determines that the other ink cartridge(s) 10 is (are) at the ink near-empty or empty state and executes a predetermined error process (e.g., indicates the ink near-empty or empty error on the remaining-amount indicator 11 and stops writing or updating the information indicative of the spent state on the nonvolatile memory 10E).

Figure 10:
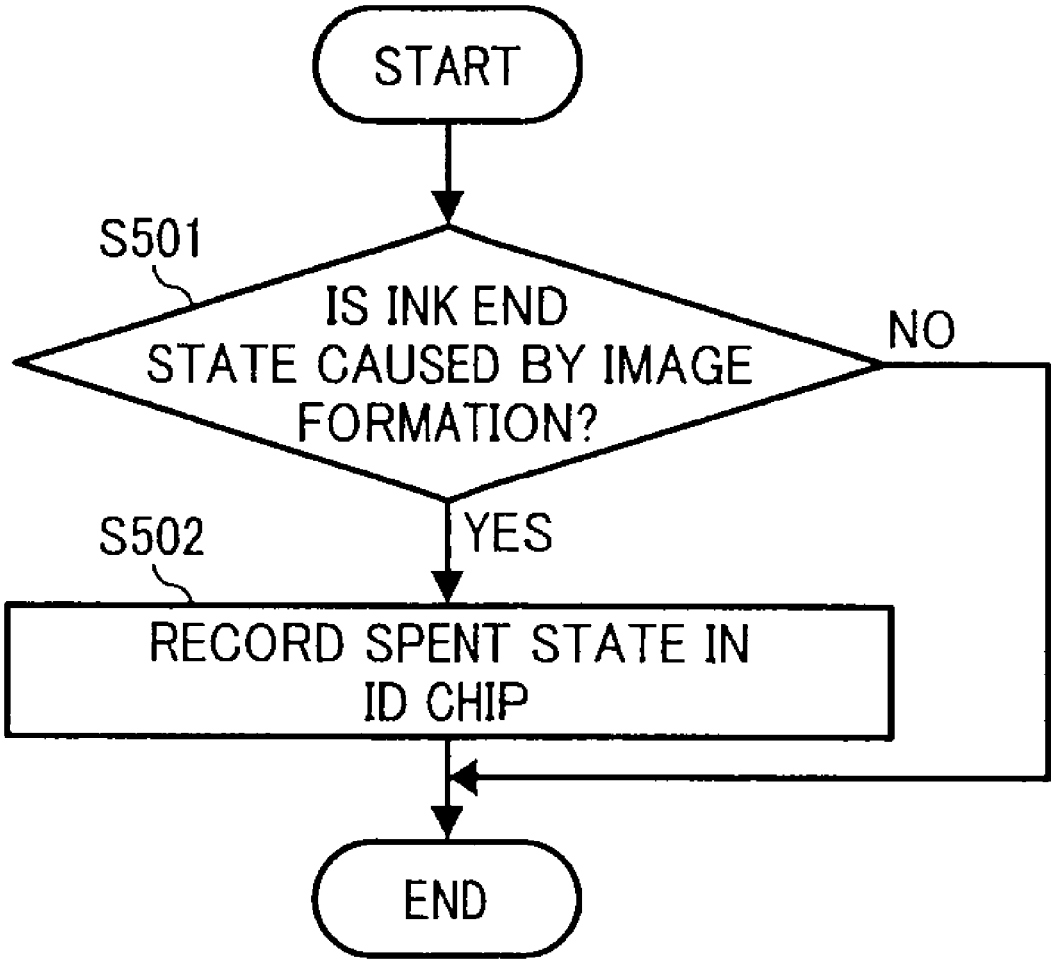
FIG. 10 is a flow chart illustrating an example of processing executed in a cartridge control unit when an ink near-empty or empty state occurs.

FIG. 10 is a flow chart illustrating an example of processing executed in the cartridge control unit 212 when an ink near-empty or empty error occurs.

[S501] At S501, when receiving a notice indicating that an ink cartridge 10 is out of ink (at the ink near-empty or empty state) from the error control unit 213, the cartridge control unit 212 determines a possible cause of the ink near-empty or empty error to select processing to be executed on the error ink cartridge 10 depending on the possible cause. At this time, if the ink near-empty or empty error is not caused by image formation, for example, a sufficient amount of ink required to execute maintenance in connection with the cartridge replacement does not remain ("NO" at S501), the cartridge control unit 212 executes no processing on the error ink cartridge 10. That is, the cartridge control unit 212 does not write or update the information indicative of the spent state on the nonvolatile memory 10E. Alternatively, information indicating that printing is executable while maintenance is not executable may be written on the nonvolatile memory 10E as a flag.

[S502] If the ink near-empty or empty error is caused by image formation and a sufficient amount of ink required for printing does not remain ("YES" at S501), at S502 the error ink cartridge 10 is rendered inoperative. For example, a bit indicative of the spent state may be recorded in an ID chip mounted on the error ink cartridge 10 to render the error ink cartridge 10 inoperative.

Even if ink remains in an ink cartridge 10, a relatively large amount of ink consumed in maintenance may cause the ink cartridge 10 to run out of ink, preventing completion of maintenance. Alternatively, when an ink-empty error occurs in an ink cartridge 10 during image formation, no ink remains in the ink cartridge 10. Therefore, processing for rendering the ink cartridge 10 inoperative may be executed. Hence, according to the present illustrative embodiment, the process illustrating in FIG. 10 is executed on an ink cartridge 10 that runs short of ink due to maintenance in the cartridge replacement so that the ink cartridge 10 can be mounted in another printer to use up the ink. By contrast, an ink cartridge 10 that runs short of ink for printing is rendered inoperative, thus preventing a user from inadvertently reusing it.

As described above, according to the present illustrative embodiment, when one of the plurality of ink cartridges 10 mounted on the inkjet recording apparatus 1000 is out of ink (at an ink near-empty or empty state), another ink cartridge(s) 10 predicted to run short of ink in the replacement of the out-of-ink cartridge is (are) informed to a user. Such configuration allows the user to prevent unnecessary repeat of cartridge replacement. Further, since the other ink cartridges are still usable in subsequent printing, a user can effectively use ink while preventing waste of ink.

More specifically, according to the present illustrative embodiment, when an ink near-empty or empty state is caused by image formation in a first one of the plurality of ink cartridges 10, the type of maintenance in cartridge replacement sequence executed in the replacement of the first error ink cartridge 10 is predicted to estimate the amount of ink required for the cartridge replacement sequence. If the amount of ink remaining in any second one of the other ink cartridges 10, except the first error ink cartridge 10, is less than the required ink amount, the second ink cartridge 10 is processed as an ink near-empty or empty error, thus allowing a user to save unnecessary time and effort required if such an ink near-empty or empty error occurs during cartridge replacement. Meanwhile, spent processing (processing of making a spent ink cartridge unusable) is not executed on the second error ink cartridge 10 in which the sufficient amount ink does not remain. As a result, the second error ink cartridge 10 can be used in another machine, thus preventing waste of ink.

The above description with reference to FIGS. 7 to 11 relates to the control of maintenance executed in the inkjet recording apparatus 1000 illustrated in FIG. 1, and more specifically, the prediction process of predicting, when an ink near-empty or empty error occurs in an ink cartridge 10, whether or not an ink near-empty or empty error occurs in the other ink cartridges except the error ink cartridge 10, and the process of handling such an ink near-empty or empty error. The present illustrative embodiment may be applicable to a recording medium storing a program that causes the relevant units of the inkjet recording apparatus 1000 to sequentially execute the above-described processes.

Such a program is, for example, a program that controls execution of relevant units in the image forming apparatus (the inkjet recording apparatus 1000) including the plurality of ink cartridges 10 each including the nonvolatile memory 10E constituting the memory on which information can be written or updated, the recording heads 34 and the sub tanks 35 constituting a plurality of image forming units to form images using ink contained in the ink cartridges 10, the ink-remaining-amount calculation unit 208 constituting an ink-remaining-amount manager to manage the amount of ink remaining in each of the ink cartridges 10, the maintenance sequence estimation unit 206 constituting a maintenance determiner to determine at least one of a need for and a type of maintenance for each of the plurality of image forming units, the cartridge control unit 212 constituting an information writer to write or update information indicative of a spent state on the memory of an error ink cartridge 10 in which an ink near-empty or empty error occurs, the maintenance-executability determination unit 207 constituting an ink amount estimator to estimate the amount of ink required to execute maintenance on each of the ink cartridges 10 and a maintenance executability determiner to compare the ink remaining amount obtained from the ink-remaining-amount manager to the required ink amount obtained from the ink amount estimator to determine whether or not maintenance is executable for each of the ink cartridges 10. The program may also control relevant units of the image forming apparatus to execute a process of, when image formation causes an ink near-empty or empty error in one of the ink cartridges 10, estimating the amount of ink required to execute maintenance on each of the other ink cartridges 10 based on a determination result by the maintenance determiner of at least one of the need for and the type of maintenance for each of the other ink cartridges 10 when the error ink cartridge 10 is replaced, and a process of, if maintenance is not executable on one of the other ink cartridges 10 based on both the estimated required ink amount and the remaining ink amount, the maintenance executability determiner determines that the second error ink cartridge 10 is at the ink near-empty or empty state and stops writing or updating the information indicative of spent state on the memory of the second error ink cartridge 10 using the information writer.

Such a program may also control relevant units of the image forming apparatus to execute an estimation process in which, when the maintenance determiner determines that maintenance should be executed on one of the image forming units, the ink-amount estimator estimates the amount of ink required to execute maintenance on the corresponding ink cartridge based on the type of maintenance for the image forming unit, which is determined by the maintenance determiner, and a process in which, if maintenance is not executable on one of the other ink cartridges 10 based on the estimated required ink amount and the remaining ink amount, the maintenance executability determiner determines that the ink cartridge 10 is at the ink near-empty or empty state and stops writing or updating the information indicative of the spent state on the memory.

Further, the program may also include a process in which the maintenance determiner determines at least one of the need for and the type of maintenance for an image forming unit depending on at least one of an air leak condition, nozzle condition, and air-bubble occurrence condition. At this time, the maintenance determiner may perform the determination process on the assumption that such air-leak condition, nozzle condition, and air-bubble occurrence condition vary with an elapse of an estimated time (estimated replacement time) from the occurrence of the ink near-empty or empty error in the error ink cartridge 10 due to image formation to the replacement of the ink cartridge 10. Further, the estimated replacement time may be based on a past record of replacement time of the ink cartridge 10.

The above-described processes may be executed by a program stored on a memory, such as a ROM, provided in the apparatus body. The program may be provided in a manner so that the program can be downloaded through a network, such as the Internet, and installed from an information processing apparatus (host machine) to the image forming apparatus. In one example, the above-described processes may be executed by a printer driver of the information processing apparatus (the host machine). Alternatively, in another example, the above-described program may be recorded or stored on a recording medium so that the program can be executed by the image forming apparatus (e.g., the inkjet recording apparatus 1000 illustrated in FIG. 1).

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, as described above, any one of the above-described and other methods of the present invention may be embodied in the form of a computer program stored in any kind of recording or storage medium.

Examples of such a recording or storage medium include, but are not limited to, flexible disk, hard disk, optical discs, magneto-optical discs, magnetic tapes, nonvolatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

What is claimed is:

1. An image forming apparatus, comprising:

a plurality of ink cartridges to contain ink, each ink cartridge including a memory on which information is writable or updatable;

a plurality of image forming units to form images using the ink contained in the corresponding ink cartridges;

an ink-remaining-amount manager to manage an amount of ink remaining in each of the plurality of image forming units;

a maintenance determiner to determine at least one of a need for and a type of maintenance to be executed on each of the image forming units;

an information writer to write or update, when an ink near-empty or empty state occurs in a first one of the ink cartridges, information indicative of a spent state on the memory of the first ink cartridge;

an ink-amount estimator to estimate an amount of ink required to execute the maintenance on each of the ink cartridges; and a maintenance executability determiner to determine executability of the maintenance on each of the ink cartridges by comparing the remaining ink amount obtained from the ink-remaining-amount manager and the required ink amount obtained from the ink-amount estimator, wherein, if the ink near-empty or empty state of the first ink cartridge is caused by image formation, the ink-amount estimator estimates an amount of ink required to execute the maintenance on each of the other ink cartridges based on the at least one of the need for and the type of maintenance determined by the maintenance determiner to be executed on each of the plurality of image forming units, and wherein, if the maintenance executability determiner determines that the maintenance is not executable on at least one of the other ink cartridges based on the required ink amount and the remaining ink amount, the maintenance executability determiner determines that the at least one ink cartridge is at an ink near-empty or empty state and stops writing or updating the information indicative of the spent state on the memory of the at least one ink cartridge.

2. The image forming apparatus according to claim 1, wherein, if the maintenance determiner determines that a maintenance should be executed on a first image forming unit of the image forming units depending on a condition of the first image forming unit, the ink-amount estimator estimates an amount of ink required to execute a maintenance on a corresponding ink cartridge of the ink cartridges based on the type of maintenance determined by the maintenance determiner to be executed on the first image forming unit, and, if the maintenance is not executable on the corresponding ink cartridge based on the required ink amount and the remaining ink amount, the maintenance executability determiner determines that the corresponding ink cartridge is at an ink near-empty or empty state and stops writing or updating the information indicative of the spent state on the memory of the corresponding ink cartridge.

3. The image forming apparatus according to claim 1, wherein the maintenance determiner determines the at least one of the need for and the type of maintenance to be executed on each of the image forming units based on at least one of an air-leak condition, a nozzle condition, and an air-bubble occurrence condition.

4. The image forming apparatus according to claim 3, wherein the maintenance determiner determines the at least one of the need for and the type of maintenance to be executed on each of the image forming units on assumption that the air-leak condition, the nozzle condition, and the air-bubble-occurrence condition vary with an elapse of time from when the ink near-empty or empty state of the first ink cartridge is caused by image formation to when the first ink cartridge is replaced.

5. The image forming apparatus according to claim 4, wherein a total of the time from when the ink near-empty or empty state of the first ink cartridge is caused by image formation to when the first ink cartridge is replaced is estimated based on a past record of replacement time of the first ink cartridge.

6. An image forming method used in an image forming apparatus including a plurality of ink cartridges to contain ink, each ink cartridge including a memory on which information is writable or updatable, and a plurality of image forming units to form images using the ink contained in the corresponding ink cartridges, the method comprising:

managing an amount of ink remaining in each of the plurality of image forming units;

determining at least one of a need for and a type of maintenance to be executed on each of the image forming units;

writing or updating, when an ink near-empty or empty state occurs in a first one of the ink cartridges, information indicative of a spent state on the memory of the first ink cartridge;

estimating an amount of ink required to execute the maintenance on each of the ink cartridges; and determining executability of the maintenance on each of the ink cartridges by comparing the remaining ink amount and the required ink amount, wherein, if the ink near-empty or empty state of the first ink cartridge is caused by image formation, the estimating estimates an amount of ink required to execute the maintenance on each of the other ink cartridges based on the at least one of the need for and the type of maintenance determined in the determining the at least one of the need for and the type of maintenance to be executed on each of the plurality of image forming units, and wherein, if the determining executability of the maintenance determines that the maintenance is not executable on at least one of the other ink cartridges based on the required ink amount and the remaining ink amount, the method includes determining that the at least one ink cartridge is at an ink near-empty or empty state and stopping writing or updating the information indicative of the spent state on the memory of the at least one ink cartridge.

7. The method according to claim 6, wherein, if the determining the at least one of the need for and the type of maintenance determines that maintenance should be executed on a first image forming unit of the image forming units depending on a condition of the first image forming unit, the estimating estimates an amount of ink required to execute a maintenance on a corresponding ink cartridge of the ink cartridges based on the type of maintenance determined for the first image forming unit, and, if the maintenance is not executable on the corresponding ink cartridge based on the required ink amount and the remaining ink amount, the method includes determining that the corresponding ink cartridge is at an ink near-empty or empty state and stopping writing or updating the information indicative of the spent state on the memory of the corresponding ink cartridge.

8. The method according to claim 6, wherein the determining the at least one of the need for and the type of maintenance determines the at least one of the need for and the type of maintenance to be executed on each of the image forming units based on at least one of an air-leak condition, a nozzle condition, and an air-bubble occurrence condition.

9. The method according to claim 8, wherein the determining the at least one of the need for and the type of maintenance determines the at least one of the need for and the type of maintenance to be executed on each of the image forming units on assumption that the air-leak condition, the nozzle condition, and the air-bubble-occurrence condition vary with an elapse of time from when the ink near-empty or empty state of the first ink cartridge is caused by image formation to when the first ink cartridge is replaced.

10. The method according to claim 9, further comprising estimating a total of the time from when the ink near-empty or empty state of the first ink cartridge is caused by image formation to when the first ink cartridge is replaced based on a past record of replacement time of the first ink cartridge.

11. A recording medium storing program codes causing an image forming apparatus to execute an image forming method, the image forming apparatus including a plurality of ink cartridges to contain ink, each ink cartridge including a memory on which information is writable or updatable, and a plurality of image forming units to form images using the ink contained in the corresponding ink cartridges, the method comprising:

managing an amount of ink remaining in each of the plurality of image forming units;

determining at least one of a need for and a type of maintenance to be executed on each of the image forming units;

writing or updating, when an ink near-empty or empty state occurs in a first one of the ink cartridges, information indicative of a spent state on the memory of the first ink cartridge;

estimating an amount of ink required to execute the maintenance on each of the ink cartridges; and determining executability of the maintenance on each of the ink cartridges by comparing the remaining ink amount and the required ink amount, wherein, if the ink near-empty or empty state of the first ink cartridge is caused by image formation, the estimating estimates an amount of ink required to execute the maintenance on each of the other ink cartridges based on the at least one of the need for and the type of maintenance determined in the determining the at least one of the need for and the type of maintenance to be executed on each of the plurality of image forming units, and wherein, if the determining executability of the maintenance determines that the maintenance is not executable on at least one of the other ink cartridges based on the required ink amount and the remaining ink amount, the method includes determining that the at least one ink cartridge is at an ink near-empty or empty state and stopping writing or updating the information indicative of the spent state on the memory of the at least one ink cartridge.

12. The recording medium according to claim 11, wherein, if the determining the at least one of the need for and the type of maintenance determines that a maintenance should be executed on a first image forming unit of the image forming units depending on a condition of the first image forming unit, the estimating estimates an amount of ink required to execute a maintenance on a corresponding ink cartridge of the ink cartridges based on the type of maintenance determined in the determining the at least one of the need for and the type of maintenance to be executed on the first image forming unit, and, if the maintenance is not executable on the corresponding ink cartridge based on the required ink amount and the remaining ink amount, the method includes determining that the corresponding ink cartridge is at an ink near-empty or empty state and stopping writing or updating the information indicative of the spent state on the memory of the corresponding ink cartridge.

13. The recording medium according to claim 11, wherein the determining the at least one of the need for and the type of maintenance determines the at least one of the need for and the type of maintenance to be executed on each of the image forming units based on at least one of an air-leak condition, a nozzle condition, and an air-bubble occurrence condition.

14. The recording medium according to claim 13, wherein the determining the at least one of the need for and the type of maintenance determines the at least one of the need for and type of maintenance to be executed on each of the image forming units on assumption that the air-leak condition, the nozzle condition, and the air-bubble-occurrence condition vary with an elapse of time from when the ink near-empty or empty state of the first ink cartridge is caused by image formation to when the first ink cartridge is replaced.

15. The recording medium according to claim 14, further comprising estimating a total of the time from when the ink near-empty or empty state of the first ink cartridge is caused by image formation to when the first ink cartridge is replaced based on a past record of replacement time of the first ink cartridge.

* * * * *